US005941758A

United States Patent [19]

Mack

[11] Patent Number: 5,941,758

[45] Date of Patent: Aug. 24, 1999

[54] METHOD AND APPARATUS FOR CHEMICAL-MECHANICAL POLISHING

[75] Inventor: Kenneth D. Mack, San Jose, Calif.

[73] Assignee: Intel Corporation, Santa Clara, Calif.

[21] Appl. No.: 08/746,551

[22] Filed: Nov. 13, 1996

[51] Int. Cl.[6] ..... B24B 5/00

[52] U.S. Cl. ..... 451/41; 457/285; 457/286; 457/287; 451/41

[58] Field of Search ..... 451/285–290, 451/41, 397, 398, 55

[56] References Cited

U.S. PATENT DOCUMENTS

| | | | |
|---|---|---|---|
| 5,081,795 | 1/1992 | Tanaka et al. | 451/285 |
| 5,205,082 | 4/1993 | Shendon et al. | 451/287 |
| 5,449,316 | 9/1995 | Strasbaugh | 451/289 |
| 5,584,746 | 12/1996 | Tanaka et al. | 451/289 |
| 5,588,902 | 12/1996 | Tominaga et al. | 451/285 |
| 5,605,488 | 2/1997 | Ohashi et al. | 451/7 |

FOREIGN PATENT DOCUMENTS

| | | | |
|---|---|---|---|
| 406015563 | 1/1994 | Japan | 451/287 |

*Primary Examiner*—Robert A. Rose
*Assistant Examiner*—George Nguyen
*Attorney, Agent, or Firm*—Blakely, Sokoloff, Taylor & Zafman

[57] ABSTRACT

A method and apparatus for uniformly polishing thin films formed on a semiconductor substrate. A substrate is placed face down on a moving polishing pad so that the thin film to be polished is placed in direct contact with the moving polishing pad. To promote uniform polishing, a multiple pressure zone back pressure wafer carrier is used to apply different pressures to different portions of the backside of the substrate, forcibly pressing the substrate against the polishing pad with pneumatic or hydraulic pressure during polishing.

19 Claims, 2 Drawing Sheets

METHOD AND APPARATUS FOR CHEMICAL-MECHANICAL POLISHING

BACKGROUND OF THE INVENTION

1. Field of the Invention

The present invention relates to the field of semiconductor manufacturing and, more specifically, to an improved method and apparatus for chemical-mechanical polishing.

2. Description of Relevant Art

Nonplanar surfaces, when present in integrated circuits having complex, high density multilevel interconnections, may cause the optical resolution of photolithographic processing steps to be poor, which could inhibit the printing of high density lines. Another problem that nonplanar surface topography may cause relates to step coverage of metal layers. If steps are too high or uneven, open circuits could be created. It is thus important, when making such complex integrated circuits, to planarize the surface of many of the layers that make up the device.

Various techniques have been developed to planarize certain layers formed during the process of making integrated circuits. In one approach, known as chemical-mechanical polishing, protruding steps, such as those that may be formed along the upper surface of interlayer dielectrics ("ILDs"), are removed by polishing. Chemical-mechanical polishing may also be used to "etch back" conformally deposited metal layers to form planar plugs or vias.

In a typical chemical-mechanical polishing method, a silicon substrate or wafer is placed face down on a rotating table covered with a flat polishing pad, which has been coated with an active slurry. A carrier, which may be made of a thick nonflexible metal plate that is attached to a rotatable shaft, is used to apply a downward force against the backside of the substrate. A retaining ring may be used to center the substrate onto the carrier to prevent it from slipping laterally. A resilient carrier pad, positioned between the metal plate and the substrate, typically is used to press against the backside of the substrate. By applying the downward force, while rotating the slurry covered pad for a selected amount of time, a desired amount of material may be removed from the upper surface of the thin film to planarize it.

A variation of the above described method, where a uniform pressure is applied to the backside of a wafer to improve polishing uniformity, is described in copending U.S. patent application Ser. No. 08/103,918, filed Aug. 6, 1993, assigned to this application's assignee. Although such a method generally ensures that a uniform pressure will be provided across the surface of a wafer, regardless of polishing pad or table irregularities, at times it may be desirable to vary the pressure applied to the wafer at different locations. For example, if the slurry applied to the polishing pad is thicker near the edges of the wafer than at the wafer's center, one may wish to apply a higher pressure to the center of the wafer than at the edge. One may similarly wish to vary the pressure applied to different portions of the wafer to account for uneven polishing pad wear, or differences in the rate of removal of material from the wafer at different regions of the wafer.

Accordingly, there is a need for an improved chemical-mechanical polishing method and apparatus that enables the user to vary the pressure applied to different regions of the wafer in a controlled manner, when desirable to enhance polishing uniformity.

SUMMARY OF THE INVENTION

An improved method and apparatus for polishing thin films formed on a semiconductor substrate is described. A substrate to be polished is placed face down in direct contact with a moving polishing pad. During polishing, a first portion of the substrate is pressed down against the polishing pad by a first fluid maintained at a first pressure applied directly to a first portion of the backside of the substrate. A second portion of the substrate is pressed down against the polishing pad by a second fluid maintained at a second pressure applied directly to a second portion of the backside of the substrate. Preferably, a wear-resistant retaining ring adjacent to and surrounding the outer edge of the substrate is pressed down against the polishing pad with a third pressure applied by a mechanical force. The substrate preferably is rotated during polishing to help facilitate uniform polishing.

The present invention provides a method of chemical-mechanical polishing which allows different pressures to be applied in a controlled manner to different portions of the substrate. This method enables one to adjust the pressure applied to different portions of the substrate in response to differences in wafer thickness, table or carrier irregularities, uneven polishing pad wear, or differences in slurry coverage.

Other advantages of the present invention will be apparent from the detailed description which follows.

DETAILED DESCRIPTION OF THE PRESENT INVENTION

An improved method and apparatus for the chemical-mechanical polishing of thin films formed on a semiconductor substrate is described. In the following description numerous specific details are set forth, such as specific components, materials, operating pressures, etc., to provide a thorough understanding of the present invention. It will be apparent, however, that the present invention may be practiced with apparatus and processes that vary from those specified here.

Figure 1:
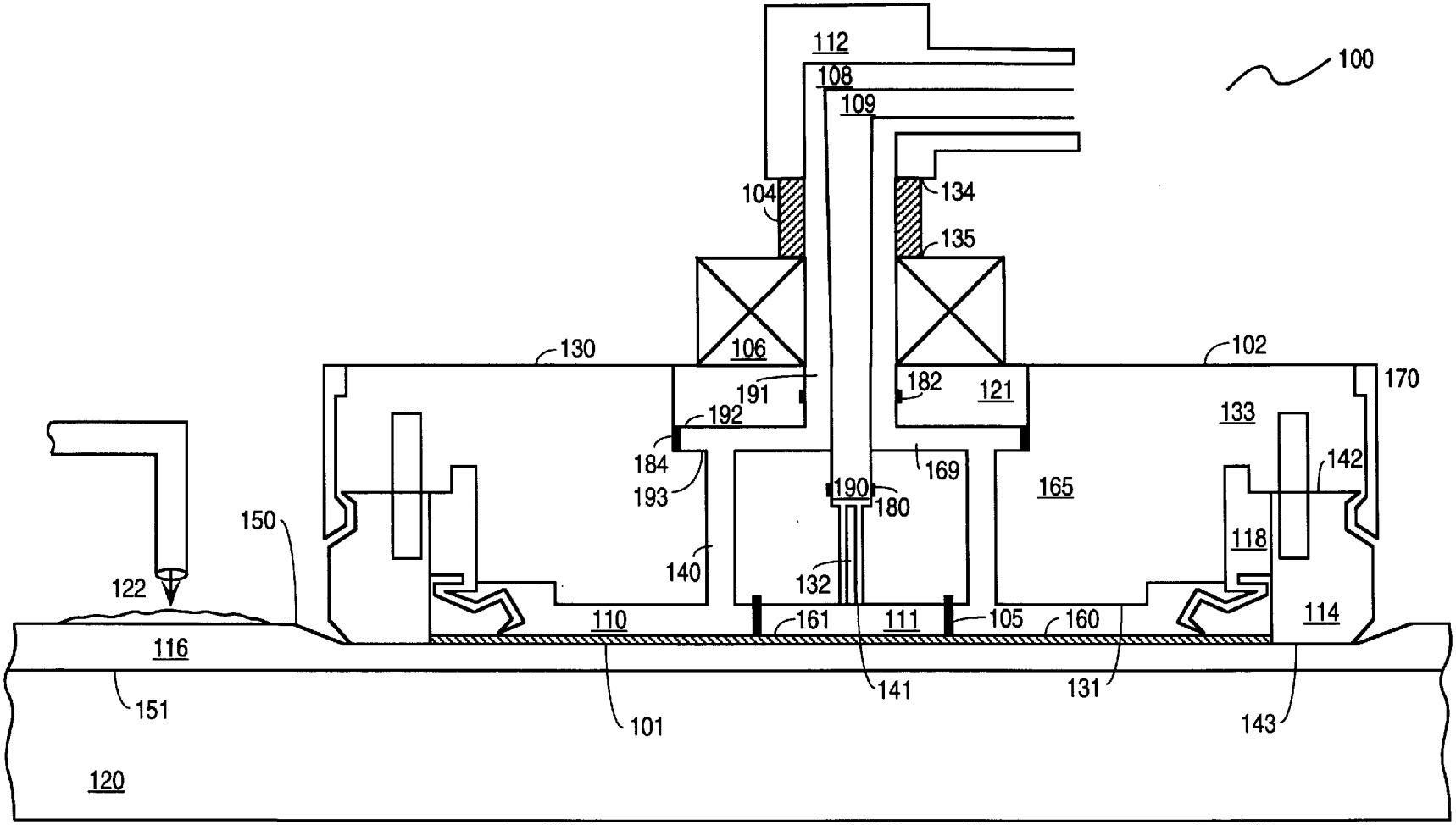
FIG. 1 is cross-sectional illustration of an embodiment of the improved wafer polishing apparatus of the present invention.

The present invention relates to chemical-mechanical polishing techniques which can be used to vary in a controlled manner the pressure applied across the backside of a substrate, e.g., a wafer, when being polished. FIG. 1 is a cross-sectional illustration of an improved wafer or substrate polishing apparatus that includes multiple pressure zone back pressure carrier 100, which can be used in the chemical-mechanical polishing process of the present invention. Wafer carrier 100 has a circular stainless steel base 102 that consists of main body 165 and plate 121. Base 102 has a top surface 130, a bottom surface 131, a center 132, and a periphery 133. Top surface 130 of base 102 is coupled to steel rotatable drive shaft 104, which has a first end 134 and a second end 135, by a flexible coupling 106, such as a gimbal, to correct for angular misalignments. In the preferred embodiment shown in FIG. 1, rotary drive shaft 104 encloses first and second concentric channels 108 and 109. Channels 108 and 109 are aligned with first and second concentric conduits 140 and 141, respectively. Conduits 140 and 141 allow a fluid to pass through base 102 into first and second concentric chambers 110 and 111, respectively. Chambers 10 and 111 are located between wafer 101 and base 102. The fluid fed into chambers 110 and 111 may be a pneumatic fluid, such as air, or a hydraulic fluid.

In the FIG. 1 embodiment of the present invention, a hollow rotating union 112 couples first end 134 of shaft 104 to an air pressure supply (not shown) such as a compressor. Rotary union 112 allows air to be injected through channels 108 and 109 and conduits 140 and 141 into chambers 110 and 111, respectively, at selected pressures as shaft 104 and base 102 rotate during polishing.

A wear-resistant retaining ring 114, having an inner surface 142 and an outer surface 143, is coupled to the periphery 133 of the bottom surface 131 of base 102. Retaining ring 114 preferably is made of a hard machinable plastic, but alternatively may be made of a ceramic or composite material. In FIG. 1, retaining ring 114 is shown surrounding and contacting the outside edge of wafer 101. Retaining ring 114 prevents wafer 101 from slipping laterally from carrier 100. Retaining ring 114 rides in direct contact with the upper surface 150 of polishing pad 116 and provides vertical loading on polishing pad 116. A first seal 118, shown in FIG. 1 as a resilient lip seal, is coupled to bottom surface 131 of base 102 just inside retaining ring 114. Lip seal 118 preferably covers approximately the outer 10 mm diameter of wafer 101. Because lip seal 118 is flexible, it allows vertical movement of wafer 101, which creates a leak-tight seal against the backside of wafer 101, the side of carrier base 102, and the inside of retaining ring 114. This enables air fed into chamber 110 to apply pneumatic pressure directly against the backside of wafer 101 to maintain a uniform downward force. Note that increasing air pressure in chamber 110 causes lip seal 118 to form an even stronger seal.

Chambers 110 and 111 are separated by second seal 105, which may be an O-ring made of a urethane, silicone or another flexible rubber like material. O-ring 105 is coupled to the bottom surface 131 of base 102 between lip seal 118 and center 132 of base 102. Separate regulators (not shown) may be used to control the pressure applied to different portions of wafer 101. In the embodiment shown in FIG. 1, a first pressure generated by a first fluid is applied against a first concentric portion 160 of the backside of wafer 101 and a second pressure generated by a second fluid is applied against a second concentric portion 161 of the backside of wafer 101. The first and second pressures are each preferably less than about 12 lbs/in.$^2$, as too high a pressure may cause the polishing to proceed too rapidly for effective control. More preferably, the first and second pressures should be between about 0.5 and 10 lbs/in.$^2$, and most preferably between about 1 and 8 lbs/in.$^2$. In many applications, it may be desirable to control the first and second pressures such that they differ by at least about 5%, but not more than about 50%. For example, when the first pressure is 8 lbs/in.$^2$, the second pressure preferably is between 4 and 12 lbs/in.$^2$. When the first pressure is 1 lb/in.$^2$, the second pressure preferably is between about 0.5 and 1.5 lbs/in.$^2$. The optimum pressure to be applied to the backside of wafer 101 will vary depending upon the composition of the layer to be polished. In many applications, it may be desirable to control the first and second pressures and the pressure exerted by retaining ring 114 against pad 116 such that these three pressures differ by less than 1 lb/in.$^2$ In the embodiment shown in FIG. 1, pressure is maintained in carrier 100 by O-ring 180 sealing lower end 190 of channel 109 against main body 165 of base 102, O-ring 182 sealing lower end 191 of channel 108 against plate 121 of base 102, and O-ring 184 sealing bottom surface 192 of plate 121 against upper surface 193 of main body 165.

By surrounding the outer edge of wafer 101 with retaining ring 114 and by keeping the polishing surface of wafer 101 substantially coplanar with the bottom surface of retaining ring 114, "edge rounding" may be substantially reduced or eliminated. During polishing, retaining ring 114 and wafer 101 compress pad 116. Because the bend of pad 116 is at the outer edge of retaining ring 114, the high pressure area resulting from the pad bend is below retaining ring 114.

The precise amount of pressure applied by retaining ring 114 against pad 116, relative to the polishing pressure applied by wafer 101, strongly effects the edge rounding behavior. For this reason, one should take care when varying the pressure that retaining ring 114 applies to pad 116 from the polishing pressure exerted in chamber 110 against wafer 101 to ensure polish uniformity at the edge of wafer 101. A lower pressure on retaining ring 114 increases the pressure at the edge of wafer 101 and thereby can cause the edge of wafer 101 to polish at a greater rate than the portion of wafer 101 positioned beneath chamber 110. A higher pressure on retaining ring 114 decreases the pressure at the edge of wafer 101 and thereby can cause the edge of wafer 101 to polish at a lower rate than the portion of wafer 101 positioned beneath chamber 110.

If there is wafer or film thickness nonuniformity near the outer edge, varying the pressure exerted by retaining ring 114 and chamber 110 may compensate for this condition.

In some cases, applying slightly less mechanical pressure, e.g., about 1 lb/in$^2$, on retaining ring 114 than the pneumatic pressure exerted on the backside of the portion of wafer 101 positioned beneath chamber 110 may help produce a substantially uniform polish rate over the entire wafer surface. Such a condition may be desirable, if the pressure exerted on the outer edge of wafer 101 is slightly lower because of the presence of lip seal 118 around the outer 10 mm edge of wafer 101. In this case, a lower pressure applied by retaining ring 114 against pad 116 can compensate for a lower pneumatic pressure applied to the outer edge of wafer 101.

Snap ring 170 holds retaining ring 114 to periphery 133 of base 102. Preferably, outer surface 143 of retaining ring 114 extends beyond bottom surface 131 of base 102 by no more than about 0.1 inches, as too much spacing between bottom surface 131 and wafer 101 could possibly prevent an effective seal between lip seal 118 and wafer 101.

Figure 2:
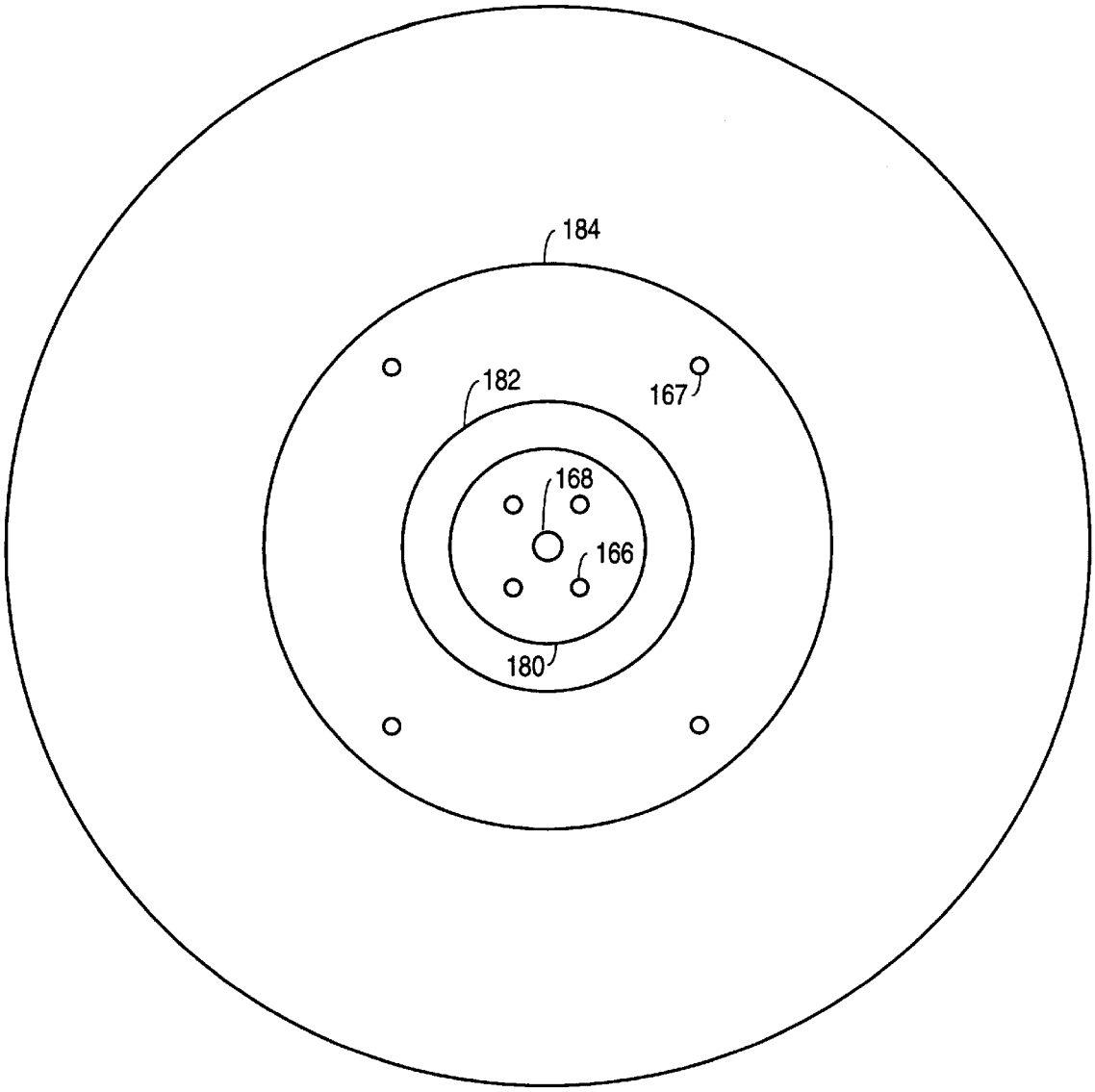
FIG. 2 is a schematic illustration of a top view of the main body of the carrier of the embodiment of the present invention shown in FIG. 1.

FIG. 2 is a schematic illustration of a top view of main body 165 of carrier 102. Shown are gimbal point 168, four orifices 166, which comprise conduit 141, and four orifices 167, which comprise conduit 140. Also represented are O-rings 180, 182 and 184, (Although not integrated into main body 165 of base 102, but rather into plate 121 of base 102, FIG. 2 shows O-ring 182 to illustrate the relative radial position between O-ring 182 and O-rings 180 and 184.) Multiple pressure zones are created by feeding air at selected pressures through conduit 141 into chamber 111 and through conduit 140 into chamber 110.

When using the chemical-mechanical polishing apparatus shown in FIG. 1, wafer 101 is placed face down on the upper surface 150 of polishing pad 116, which is fixedly attached to the upper surface 151 of table 120. In this manner, the thin film to be polished on wafer 101 is placed in direct contact with polishing pad 116. Air is injected through rotary union 112, channels 108 and 109 of rotary drive shaft 104, and conduits 140 and 141 into chambers 110 and 111, respectively, against the backside of wafer 101. Air passing through channel 109 is fed directly to conduit 141 for injection into chamber 111; whereas, air passing through channel 108 expands radially into concentric aperture 169, which is positioned between bottom surface 192 of plate 121 and upper surface 193 of main body 165, prior to funneling through conduit 140 into chamber 110. Pressure exerted by the injected air is maintained during polishing. Additionally, a mechanical downward force is applied to rotary union 112 and shaft 104 so that retaining ring 114 provides a downward pressure on pad 116. The mechanical force preferably is adjusted so that retaining ring 114 provides pressure on pad 116 which is approximately equal to, or slightly less than, the pneumatic pressure applied against the backside of wafer 101 in chamber 110. In this way the bottom surface 143 of retaining ring 114 and the face of wafer 101 are substantially coplanar during polishing.

An abrasive slurry 122 is deposited onto the upper surface 150 of polishing pad 116 during polishing. A wide variety of well-known slurries can be used for polishing. The actual composition of the slurry depends upon the specific material to be polished. Slurries are generally silica based solutions which have additives dependent upon the type of material to be polished. A slurry known as SC3010 which is manufactured by Cabot Inc. may be used to polish oxide ILDs. For polishing of tungsten metal layers, a slurry comprising potassium ferricyanide and cellodial silica with a pH adjusted to a value of less than 6.2 may be used. Slurry may be applied directly to the wafer/pad interface as described in U.S. Pat. No. 5,554,064, issued Sep. 10, 1996, and assigned to this application's assignee.

Grooves can be formed in pad 116 to help transport slurry to the wafer/pad interface. Pad 116 and table 120 can be rotated by well-known means such as by a belt and a variable speed motor. In a similar manner carrier 100 can be rotated during polishing by rotating shaft 104. Wafer 100 is polished through the combined action of the slurry, the rotational movement of pad 116 relative to wafer 101, and application of pneumatic pressure to the backside of wafer 101 and of mechanical pressure to retaining ring 114. Polishing continues until the desired amount of thin film has been removed or the desired amount of planarity has been achieved.

Pad 116 need not necessarily be rotated. Relative movement between pad 116 and wafer 101 may be achieved through other means, such as those described in U.S. Pat. No. 5,554,064, issued Sep. 10, 1996, and assigned to this application's assignee. The polishing pad can be made of a variety of materials. For example, when planarizing an oxide based interlayer dielectric, the pad may be made of a relatively hard polyurethane or similar material. When polishing a metal such as tungsten, as in the etchback step of a plug formation process, the pad may be made of a urethane impregnated felt pad. Because the polishing pad can become worn to the point where slurry particles may not be delivered uniformly to all portions of the wafer/pad interface during polishing, a pad conditioning apparatus may be employed to restore the proper pad surface roughness to enable proper delivery of the slurry. Such a conditioning apparatus is described in U.S. Pat. No. 5,216,843 entitled: Polishing Pad Conditioning Apparatus For Wafer Planarization Process, assigned to this application's assignee.

An important feature of the present invention is that it permits one to apply different amounts of pressure to different portions of the wafer. In certain situations, one may wish to apply different pressures to different portions of the wafer to compensate for different slurry thicknesses, or irregularities in the rate of material removal (which may be due to uneven polishing pad wear or slight warpage of the polish table, for example).

As an illustration, polishing pad 116 could wear unevenly, producing a pad having a concave depression near its center. Such a concave depression decreases the polishing pressure towards the center of wafer 101 and thereby reduces the polish removal rate at the center of wafer 101. By varying the pressure applied to the backside of wafer 101 near its center, wafer 101 can bend to conform to the concave shape, and thereby remain in contact with pad 116. At the same time, peripheral regions of wafer 101, although subject to a slightly different pressure, can also contact pad 116. In this way, the polish removal rate across the surface of wafer 101 may remain uniform even as pad 116 begins to wear. This may increase wafer throughput and decrease cost by allowing more wafers to be uniformly and reliably polished per pad.

Varying the pressure at different regions of the wafer thus can help ensure that the polishing pressure distribution across the surface of a wafer will be uniform, irrespective of polishing pad, wafer, table, or carrier irregularities.

Normally, the techniques of the present invention are used to planarize very thin ILD and metal films formed over a semiconductor substrate. Such ILD films may comprise $SiO_2$ formed over and between two metal layers of a semiconductor device. Such metal films may comprise tungsten, conformally deposited onto an ILD layer and into via openings, which are polished back to form planar plugs or vias. The method and apparatus of the present invention is not limited, however, to application on ILD layers and metal plugs. The apparatus and method of the present invention may be used with any number of thin films used in semiconductor integrated circuit manufacturing such as, but not limited to, metal interconnection layers, organic layers, and even the semiconductor material itself. Accordingly, the method and apparatus of the present invention applies generally to polishing processes where fluids of different pressure are used to vary in a controlled manner the polishing pressure applied across the surface of the substrate to help ensure that the substrate is polished in a uniform manner.

The chemical-mechanical polishing techniques of the present invention help create a uniform polish pressure across the surface of a wafer being polished. The techniques of the present invention can be used independently, or in combination with one another, or in combination with other well-known techniques to improve polishing pressure uniformity without departing from the scope of the present invention. It will be apparent to those skilled in the art that many alterations and modifications may be made to the described apparatus and method without departing from the invention.

By way of example only, the number, orientation, size and shape of chambers, types of fluid fed into the chambers, and means for transporting fluid into the chambers may be altered to suit a particular application or processing environment. In this regard, although the embodiment shown in FIG. 1 only includes two concentric chambers—enabling application of two different pressures onto two concentric sections of the backside of the wafer—the number of chambers may be increased, when desiring to subject additional wafer regions to different pressures. For example, chambers may be added by adding concentric plates to main body 165 of base 102, while adding a corresponding number of channels to shaft 104, conduits through base 102 and O-rings to seal the additional channels against the additional plates and the additional plates against main body 165. The present invention further contemplates application of either linear or nonlinear pressure gradients to the backside of the wafer, e.g., reducing the pressure applied against the backside of the wafer in a linear fashion from the wafer's center to its periphery.

In addition, although the illustrative embodiment describes transporting fluid via two concentric channels aligned with two concentric conduits, fluid alternatively may be transported to zones or chambers of varying pressure located above the wafer by bundling multiple tubes through a hollow rotatable shaft, by adding a baffled manifold that empties into separate zones above the wafer through a series of orifices, or by using other means for distributing fluid into separated regions located above the wafer. The channels and conduits through which the fluid is fed may have a nonconcentric orientation or shape. Also, different fluids may be fed through different channels and conduits into different chambers.

Many other modifications from the specifically described apparatus and process will be readily apparent to those skilled in the art. Accordingly, it is intended that all such modifications and alterations be considered as within the spirit and scope of the invention as defined by the appended claims.

What is claimed is:

1. A method for the chemical-mechanical polishing of a thin film formed on a silicon substrate having a thin film side and a backside, comprising:

placing the silicon substrate on a polishing pad such that the surface of the thin film contacts the polishing pad; then, while causing relative movement between the polishing pad and the silicon substrate, applying a first pressure generated by a first fluid against a central portion of the backside of the substrate; and applying a second pressure generated by a second fluid against a peripheral portion of the backside of the substrate.

2. The method of claim 1 wherein the first fluid and second fluid are pneumatic.

3. The method of claim 1 wherein the substrate is substantially circular and which further includes the step of pressing a retaining ring, which engages the outer edge of the substrate, against the polishing pad such that the retaining ring applies pressure to the polishing pad.

4. The method of claim 3 including the step of pressing the retaining ring against the polishing pad until the retaining ring lies in substantially the same plane as the substrate.

5. The method of claim 1 wherein the first pressure and the second pressure in combination apply pressure against substantially all of the backside of the substrate.

6. The method of claim 1 wherein the first pressure and the second pressure are each less than about 12 lb/in.$^2$.

7. The method of claim 1 wherein the first pressure and the second pressure are each between about 0.5 and about 10 lb/in.$^2$.

8. The method of claim 1 wherein the first pressure and the second pressure differ by at least about 5%.

9. The method of claim 1 wherein the first pressure and the second pressure differ by less than about 50%.

10. The method of claim 1 wherein the first pressure and the second pressure applied to the backside of the substrate, and the pressure applied by the retaining ring against the polishing pad differ by less than about 1 lb/in.$^2$.

11. A multiple pressure zone back pressure wafer carrier for the chemical-mechanical polishing of a thin film formed on a silicon substrate comprising:

a base having a top surface and a bottom surface and a center and a periphery;

a retaining ring coupled to the periphery of the bottom surface of the base;

a first seal coupled to the bottom surface of the base between the retaining ring and the center of the base;

a second seal coupled to the bottom surface of the base between the first seal and the center of the base;

a first conduit passing through the base and opening between the first seal and the second seal; and a second conduit passing through the base and opening between the second seal and the center of the base.

12. The wafer carrier of claim 11 further comprising a rotary shaft having a first end and a second end wherein the second end is coupled to the top surface of the base.

13. The wafer carrier of claim 12 wherein the rotary shaft comprises first and second channels, the first channel aligned with the first conduit and the second channel aligned with the second conduit.

14. The carrier of claim 13 further comprising a hollow rotary union coupled to the first end of the shaft.

15. The carrier of claim 14 wherein the retaining ring includes an inner surface and an outer surface and the inner surface is coupled to the periphery of the bottom surface of the base and the outer surface extends beyond the bottom surface of the base by no more than about 0.1 inches.

16. The carrier of claim 11 wherein the retaining ring, the first seal and the second seal have a substantially circular shape.

17. The carrier of claim 16 wherein the bottom surface of the base is divided into first and second concentric chambers, the first concentric chamber located between the first seal and the second seal and the second concentric chamber enclosed by the second seal.

18. The wafer carrier of claim 17 further comprising a rotary shaft having a first end and a second end wherein the second end is coupled to the top surface of the base.

19. The wafer carrier of claim 18 wherein the shaft comprises first and second concentric channels, the first channel aligned with the first conduit and the second channel aligned with the second conduit.

* * * * *

UNITED STATES PATENT AND TRADEMARK OFFICE

CERTIFICATE OF CORRECTION

PATENT NO. :5,941,758

DATED : August 24, 1999

INVENTOR(S) : Kenneth D. Mack

It is certified that error appears in the above-identified patent and that said Letters Patent is hereby corrected as shown below:

In Column 3, at line 4, replace "10" with --110--.

Signed and Sealed this

Twenty-eighth Day of November, 2000

*Attest:*

Q. TODD DICKINSON

*Attesting Officer*

*Director of Patents and Trademarks*